United States Patent [19]

Yamane et al.

[11] Patent Number: 4,785,995

[45] Date of Patent: Nov. 22, 1988

[54] METHODS AND APPARATUS FOR CONDUCTING ELECTROSTATIC SPRAY COATING

[75] Inventors: Takakazu Yamane; Yoshio Tanimoto; Tadamitsu Nakahama, all of Hiroshima, Japan

[73] Assignee: Mazda Motor Corporation, Japan

[21] Appl. No.: 26,487

[22] Filed: Mar. 16, 1987

[30] Foreign Application Priority Data

| | | | |
|---|---|---|---|
| Mar. 18, 1986 | [JP] | Japan | 61-60090 |
| Mar. 18, 1986 | [JP] | Japan | 61-60091 |
| Mar. 18, 1986 | [JP] | Japan | 61-60092 |
| Mar. 18, 1986 | [JP] | Japan | 61-60093 |
| Mar. 18, 1986 | [JP] | Japan | 61-60094 |

[51] Int. Cl.[4] ..... B05D 1/04; B05B 5/04

[52] U.S. Cl. ..... 239/3; 118/626; 239/7; 239/214.25; 239/224; 239/703; 427/31

[58] Field of Search ..... 239/700, 703, 214.25, 239/224, 3, 7, DIG. 19; 427/31, 426; 118/626

[56] References Cited

U.S. PATENT DOCUMENTS

| | | | |
|---|---|---|---|
| 3,133,702 | 5/1964 | Stelchek | 239/7 X |
| 3,144,209 | 8/1964 | Griffiths | 239/700 X |

FOREIGN PATENT DOCUMENTS

| | | | |
|---|---|---|---|
| 57-45370 | 3/1982 | Japan . | |
| 59-228960 | 12/1984 | Japan . | |
| 2088748 | 6/1982 | United Kingdom | 239/DIG. 19 |

*Primary Examiner*—Evan Lawrence

*Attorney, Agent, or Firm*—Gerald J. Ferguson, Jr.

[57] ABSTRACT

The invention provides methods and apparatus for conducting electrostatic spray coating by which an improved coating layer made uniform in gloss, hardness, weather-tightness, and other characteristics is obtained on an object to be coated. The coating layer is formed with use of a rotary spray head device which is provided with a funnel-like body having an inner wall surface and an open end portion. The rotary spray head device is driven to turn on an axis of rotation surrounded by the inner wall surface of the funnel-like body, and supplied with plural kinds of coating material which are discharged to a substantially common location on the inner wall surface of the funnel-like body simultaneously through respective separate paths so as to form their respective layers superimposed on said inner wall surface of the funnel-like body and move toward said open end portion of the funnel-like body.

15 Claims, 7 Drawing Sheets

METHODS AND APPARATUS FOR CONDUCTING ELECTROSTATIC SPRAY COATING

BACKGROUND OF THE INVENTION

1. Field of the Invention

The present invention relates generally to methods and apparatus for conducting electrostatic spray coating, and more particularly, is directed to an improvement in a method of providing an object to be coated with a coating layer thereon through spraying coating material by a rotary spray head device and depositing electrostatically the sprayed coating material on the object, and also to an apparatus for use in such an improved method.

2. Description of the Prior Art

There has been proposed adoption of electrostatic spray coating for providing a vehicle body with a coating layer which covers uniformly the whole outer surface of the vehicle body. Generally, according to the electrostatic spray coating, an electrostatic field is formed with a high DC voltage supplied between an object to be coated, such as the vehicle body, and a spray head device disposed to face the object for spraying coating material toward the same, and the coating material sprayed by the spray head is charged with electricity in the electrostatic field and deposited on the object through electrostatic adsorption effected thereon. With use of such electrostatic spray coating the efficiency of deposition of the coating material on the object is improved so that a loss of coating material is reduced.

When the object which is subjected to the electrostatic spray coating is made of metal, coating of the baking finish type, such as one of various kinds of coating of melamine alkyd resin, is ordinarily used for forming a coating layer on the object. The coating of the baking finish type deposited on the object is dried in a heated ambience of, for example, about 140 degrees to be hardened. On the other hand, when the object which is subjected to the electrostatic spray coating is made of some material with relatively low thermal resistance such as a kind of plastic, a coating of the two liquid component type, which comprises a coating base of, for example, acrylic resin and a hardening agent, is used for forming a coating layer on the object. The coating of the two liquid component type disposed on the object is dried in an ambience of ordinary temperature to be hardened, so that the coating layer which is expected to be securely deposited on the outer surface of the object to have a surface thereof with superior gloss, hardness and weather-tightness, is formed on the object.

In general, such coating of the two liquid component type as described above is hardened in a relatively short time when the coating base and the hardening agent are mixed with each other, and therefore the coating base and hardening agent are stored separately and mixed with each other immediately before the electrostatic spray coating is conducted. Therefore, when electrostatic spray coating is conducted with the coating of the two liquid component type, a mixer is provided for mixing the coating base with the hardening agent to constitute the coating of the two liquid component type, and the coating sent out of the mixer is supplied to a spray head device so as to be sprayed thereby. Accordingly, when a change of color of the coating base is required, the mixer is to be caused to discharge the coating produced therein to the outside therefrom and to be washed thoroughly to remove the remaining coating material from the inside thereof before a new coating base of different color is supplied to the mixer together with the hardening agent. This results in a problem in that a relatively long time is wasted for washing the mixer in a sequential coating process.

For the purpose of avoiding such a problem, there has also been proposed an apparatus for performing the electrostatic spray coating without using a combination of the mixer for mixing the coating base with the hardening agent to constitute the coating of the two liquid component type and the spray device for spraying the coating, as disclosed in the Japanese patent application published before examination under publication number 57-45370 or 59-228960. Such a previously proposed apparatus is provided with a rotary spray head device which is supplied with a high DC voltage and operative to rotate at a high speed, and first and second nozzles for supplying respectively the coating base and hardening agent, which are ingredients of the coating of the two liquid component type, separately onto the inner wall surface of the rotary spray head. The coating base and hardening agent supplied onto the inner wall surface of the rotary spray head device are mixed with each other in the rotary spray head device and sprayed from the rotary spray head device due to centrifugal force resulting from the rotation of the rotary spray head device.

Then, the previously proposed apparatus is further provided with a third nozzle for supplying a washing agent, such as thinner, to the inside of the rotary spray head device. The third nozzle is disposed to have its discharging opening positioned in the vicinity of the inner wall surface of the rotary spray head device.

When the change of color of the coating base is carried out, the third nozzle is operated to supply the washing agent onto the inner wall surface of the rotary spray head device for washing the inside of the rotary spray head device after the first and second nozzles are controlled to cease to supply the coating base and hardening agent, respectively, so that the rotary spray head device is made ready for the change of color of the coating base. With such an arrangement, a time spent for the change of color of the coating base is effectively saved.

When the electrostatic spray coating is conducted with the above described apparatus which is equipped with the rotary spray head device and the first, second and third nozzles for supplying the coating base, hardening agent and washing agent, respectively, each of the coating base and hardening agent supplied onto the inner wall surface of the rotary spray head device reaches to the open end portion of the rotary spray head device so as to be sprayed therefrom in an instant, due to the centrifugal force resulting from the rotation of the rotary spray head device. Accordingly, it is feared; that the coating base and the hardening agent which ar supplied separately onto the inner wall surface of the rotary spray head device are sprayed independently from the open end portion of the rotary spray head device, and therefore the coating base and hardening agent both sprayed by the rotary spray head device are not mixed enough with each other. In the case where the coating base sprayed by the rotary spray head device is not mixed sufficiently with the hardening agent also sprayed by the rotary spray head device, an object to be coated through the electrostatic spray coating is provided on its outer surface with a coating layer which has partially excess and deficiency of the coating base or the hardening agent, and this results in a disadvantage, in that the coating layer deposited on the outer surface of the object is lacking in uniformity in gloss, hardness, weather-tightness, and other characteristics.

OBJECTS AND SUMMARY OF THE INVENTION

Accordingly, it is an object of the present invention to provide a method and apparatus for conducting electrostatic spray coating which avoid the foregoing problems encountered with the prior art.

Another object of the present invention is to provide a method and apparatus for conducting electrostatic spray coating in which a coating base and hardening agent to constitute coating of the two liquid component type or plural kinds of coating material are supplied separately to a rotary spray head device and then sprayed by the rotary spray head device toward an object to be coated, and by which the object is provided on its outer surface with a superior coating layer which is made uniform in gloss, hardness, weather-tightness, and other characteristics.

A further object of the present invention is to provide a method and apparatus for conducting electrostatic spray coating in which a coating base and hardening agent to constitute coating material of the two liquid component type or plural kinds of coating material are supplied separately to a rotary spray head device and then sprayed by the rotary spray head device toward an object to be coated in such a manner that the coating base and hardening agent, or the plural kinds of coating material are mixed sufficiently.

According to the present invention, there is provided a method of conducting electrostatic spray coating which comprises driving a rotary spray head device which is provided with a funnel-like body having an inner wall surface for guiding coating material and an open end portion at the side of larger diameter thereof, to turn on an axis of rotation surrounded by the inner wall surface of the funnel-like body, and supplying plural kinds of coating material to the inner wall surface of the funnel-like body of the rotary spray head device simultaneously through respective separate paths so that the plural kinds of coating material form their respective layers superimposed on the inner wall surface of the funnel-like body and move toward the open end portion of the funnel-like body.

According to the present invention, there is also provided a method of conducting electrostatic spray coating which comprises driving a rotary spray head device which is provided with a funnel-like body having an inner wall surface for guiding coating material and an open end portion at the side of larger diameter thereof, to turn on an axis of rotation surrounded by the inner wall surface of the funnel-like body, and supplying a coating base and a hardening agent both to constitute coating of the two liquid component type to the inner wall surface of the funnel-like body of the rotary spray head device simultaneously through respective separate paths so that the coating base and hardening agent form their respective layers superimposed on the inner wall surface of the funnel-like body and move toward the open end portion of the funnel-like body.

Also, the present invention provides an apparatus for conducting electrostatic spray coating which comprises a rotary spray head device provided with a funnel-like body having an inner wall surface for guiding coating material and an open end portion at the side of larger diameter thereof, a driving device for driving the rotary spray head device to turn on an axis of rotation surrounded by the inner wall surface of the funnel-like body, and a plurality of nozzles each having its discharging opening positioned to be close to the inner wall surface of the funnel-like body of the rotary spray head device for supplying plural kinds of coating material respectively to the inner wall surface of the funnel-like body through respective separate paths so that the plural kinds of coating material form their respective layers superimposed on the inner wall surface of the funnel-like body and move toward the open end portion of the funnel-like body.

With the method of conducting electrostatic spray coating according to the present invention, the coating base and hardening agent to constitute the coating of the two liquid component type or the plural kinds of coating material are supplied simultaneously through the respective separate paths to the inner wall surface of the funnel-like body of the rotary spray head device to as to form their respective layers superimposed on the inner wall surface of the funnel-like body and move toward the open end portion of the funnel-like body. The coating base and hardening agent or the plural kinds of coating material forming the respective layers superimposed on the inner wall surface of the funnel-like body are directly sprayed from the open end portion of the funnel-like body by means of the rotation of the funnel-like body so as to form almost innumerable sprayed particles each having a double layer or multilayer. This results in that the coating base and hardening agent or the plural kinds of coating material are sprayed by the funnel-shaped body of the rotary spray head device toward an object to be coated so as to mixed sufficiently with each other, and consequently the object is provided on its outer surface with a superior coating layer which is made uniform in gloss, hardness, weather-tightness, and other characteristics.

Also, with the apparatus of conducting electrostatic spray coating according to the present invention, the coating base and hardening agent to constitute the coating of the two liquid component type or the plural kinds of coating material are supplied separately from the respective discharging openings of the nozzles to the inner wall surface of the funnel-like body which is driven to turn by the driving device. On such occasion, the coating base and hardening agent or the plural kinds of coating material discharged from the nozzles impinge upon a common location on the inner wall surface of the funnel-like body so as to form their respective layers superimposed thereon and move toward the open end portion of the funnel-like body. Then, the coating base and hardening agent or the plural kinds of coating material forming the respective layers superimposed on the inner wall surface of the funnel-like body are directly sprayed to an object to be coated from the open end portion of the funnel-like body by means of the rotation of the funnel-like body in such a manner as to form almost innumerable sprayed particles each having a double layer or multilayer. Accordingly, the coating base and hardening agent or the plural kinds of coating material sprayed by the funnel-like body of the rotary spray head device are mixed sufficiently with each other, and therefore the object is provided on its outer surface with a superior coating layer which is made uniform in gloss, hardness, weather-tightness, and other characteristics.

The above, and other objects, features and advantages of the present invention will become apparent from the following detailed description which is to be read in conjunction with the accompanying drawings.

DESCRIPTION OF THE PREFERRED EMBODIMENTS

Figure 1:
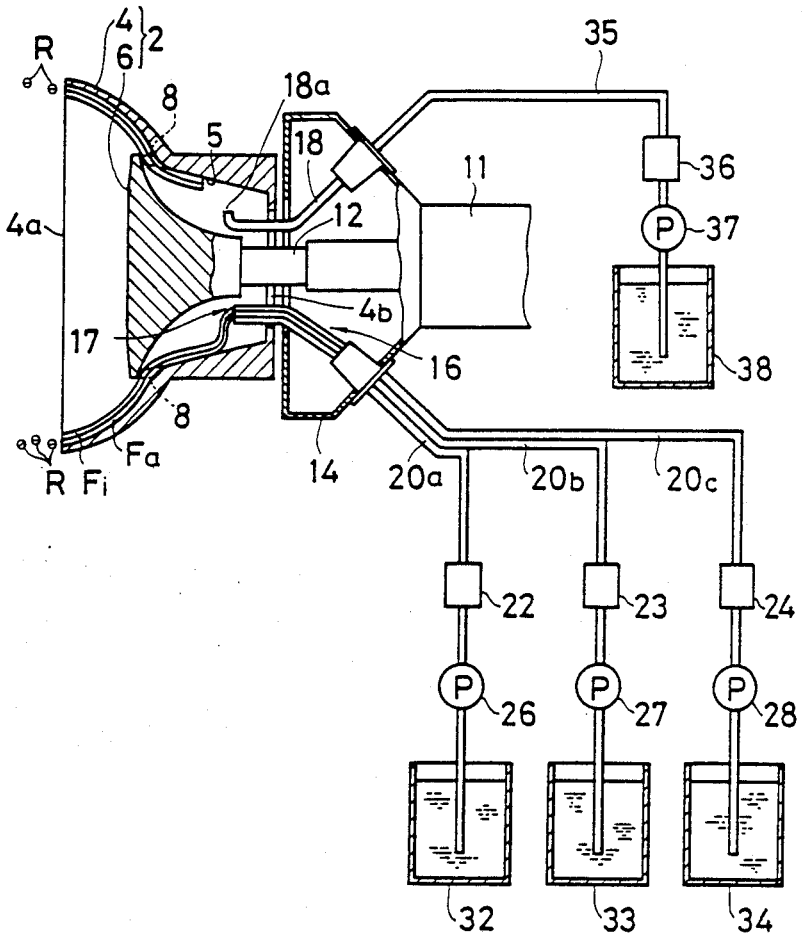
FIG. 1 is a schematic illustration showing an example of an apparatus for use in one embodiment of method of conducting electrostatic spray coating according to the present invention.

FIG. 1 shows an example of apparatus for used in one embodiment of method of conducting electrostatic spray coating according to the present invention.

In the apparatus shown in FIG. 1, a rotary spray head device 2 which comprises a funnel-like body 4 and a hub member 6 disposed at the center of the funnel-like body 4 is provided. The funnel-like body 4 has an open end portion **4*a* with a relatively large diameter, a connecting end portion 4*b* with a relatively small diameter, and a middle portion between the open end portion 4*a* and connecting end portion 4*b*, which is provided with an inner wall surface 5 for coming into contact with coating material for guiding the same. A plurality of holes 8 is provided at a connecting portion between the funnel-like body 4 and the hub member 6 for interconnecting a space surrounded by the inner wall surface 5 at the side of the open end portion 4*a* and another space surrounded by the inner wall surface 5 at the side of the connecting end portion 4*b*. A rotary shaft 12 of an air motor 11 is inserted into the inside of the funnel-like body 4 through the connecting end portion 4*b* of the same to be connected with the end portion of the hub member 6 close to the connecting end portion 4*b*. The air motor 11 is provided for driving the rotary spray head device 2 in its entirety to turn at a high speed on an axis of rotation which is surrounded by the inner wall surface 5 and passes through the center of the hub member 6 and the center of the rotary shaft 12 of the air motor 11**.

A bracket 14 is fixed to the air motor 11, and a coating supply nozzle portion 16 is mounted on the bracket 14 to have a discharging opening end 17 thereof which elongates through the connecting end portion **4*b* of the funnel-like body 4 to close to the inner wall surface 5 of the funnel-like body 4. One end of each of pipes 20*a* and 20*b* for supplying coating bases, respectively, and one end of a pipe 20*c* for supplying a hardening agent are coupled with the coating supply nozzle portion 16. The pipe 20*a* is provided with a flow controller 22 and a pump 26 on the way to a coating tank 32 to which the other end of the pipe 20*a* reaches. The pipe 20*b* is also provided with a flow controller 23 and a pump 27 on the way to a coating tank 33 to which the other end of the pipe 20*b* reaches. Further, the pipe 20*c* is provided with a flow controller 24 and a pump 28 on the way to a hardening agent tank 34 to which the other end of the pipe 20*c*** reaches.

In the coating tanks 32 and 33, different coating bases or different kinds of coating are stored. For example, a coating base composed of acrylic resin coating material including red pigment is stored in the coating tank 32 and a coating base composed of acrylic resin coating material including white pigment is stored in the coating tank 33. In the hardening agent tank 34, for example, a hardening agent of isocyanate is stored. The flow controllers 22, 23 and 24 are operative to adjust independently flow of the coating base in the pipe **20*a*, flow of the coating base in the pipe 20*b*, and flow of the hardening agent in the pipe 20*c***.

Further, a nozzle 18 for discharging a washing agent is also mounted on the bracket 14 to have a discharging opening **18*a* thereof which elongates through the connecting end portion 4*b* of the funnel-like body 4 to close to the inner wall surface 5 of the funnel-like body 4. One end of a pipe 35 for supplying the washing agent is coupled with the nozzle 18. The pipe 35 is provided with a flow controller 36 and a pump 37 on the way to a washing agent tank 38 in which, for example, thinner is stored as the washing agent and to which the other end of the pipe 35** reaches.

Figure 2:
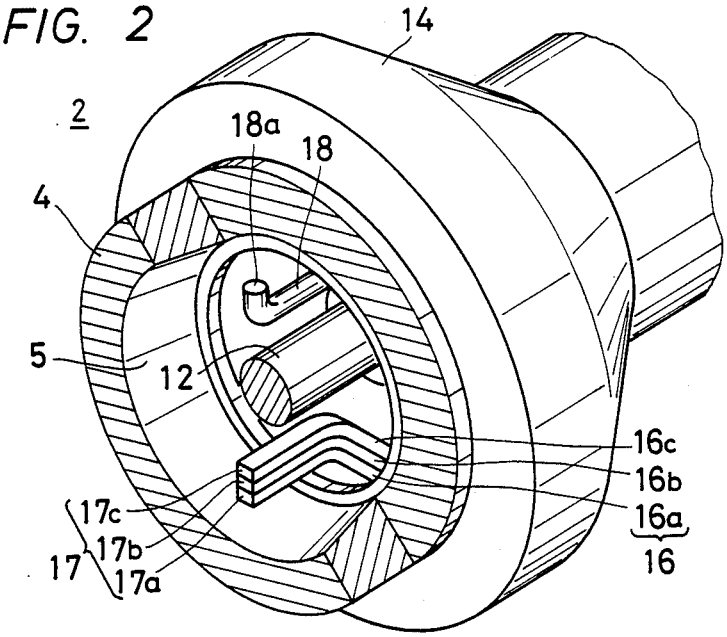
FIG. 2 is a fragmentary perspective view showing an embodiment of rotary spray head device employed in the apparatus shown in FIG. 1.

FIG. 2 shows a part of an embodiment of the rotary spray head device 2 including the coating supply nozzle portion 16 and the circumference thereof. In the embodiment of the rotary spray head device 2, the coating supplying nozzle portion 16 comprises nozzles **16*a* and 16*b* for discharging the coating bases, respectively, and a nozzle 16*c* for discharging the hardening agent. These nozzles 16*a*, 16*b* and 16*c* are connected to the one ends of the pipes 20*a*, 20*b* and 20*c*, respectively. Discharging openings 17*a*, 17*b* and 17*c* of the nozzles 16*a*, 16*b* and 16*c* which form the discharging opening end 17, are stacked in the direction perpendicular to the axis of rotation of the rotary spray head device 2, that is, in the direction along the radius of the funnel-like body 4 of the rotary spray head device 2, in the vicinity of the inner wall surface 5 of the funnel-like body 4**.

In addition, a high DC voltage is applied between the rotary spray head device 2 in its entirety and an object to be coated (not shown in the FIGS.) so as to provide the rotary spray head device 2 with a potential lower than that of the object to be coated.

When the apparatus thus constituted is used for putting the embodiment of method of conducting electrostatic spray coating according to the present invention into practice, first the air motor 11 is driven to rotate at a predetermined speed and therefore the rotary spray head device 2 is turned at a high speed of, for example, 2,000 to 3,000 r.p.m on the axis of rotation which is surrounded by the inner wall surface 5 of the funnel-like body 4 and passes through the center of the hub member 6 and the center of the rotary shaft 12 of the air motor 11. On this occasion, the rotary spray head device 2 is supplied with a negative high DC potential of, for example, <90 kV with reference to the potential of the object to be coated.

Then, the pumps 27 and 28 are caused to work so that the coating bases stored in the coating tank 33 and the hardening agent stored in the hardening agent tank 34 are supplied respectively through the pipes 20*b* and 20*c* to the nozzles 16*b* and 16*c* in the coating supply nozzle portion 16. Simultaneously with this, the flow controllers 23 and 24 are operated to adjust the flow of the coating base in the pipe 20*b* and the flow of the hardening agent in the pipe 20*c*, respectively, so that the ratio in weight of the hardening agent supplied to the nozzle 16*c* to the coating base supplied to the nozzle 16*b* is set to be one third.

The coating base supplied to the nozzle 16*b* and the hardening agent supplied to the nozzle 16*c* are discharged simultaneously from the discharging openings 17*b* and 17*c*, respectively, to the inner wall surface 5 of the funnel-like body 4 of the rotary spray head device 2 turning at the high speed. Since the discharging openings 17*b* and 17*c* of the nozzles 16*b* and 16*c* are stacked in the direction along the radius of the funnel-like body 4 of in the vicinity of the inner wall surface 5 of the funnel-like body 4, as shown in FIG. 2, the coating base discharged from the discharging opening 17*b* of the nozzle 16*b* and the hardening agent discharged from the discharging opening 17*c* of the nozzle 16*c* impinge upon a common location on the inner wall surface 5 of the funnel-like body 4 of the rotary spray head device 2 turning at the high speed.

The coating base and hardening agent discharged from the nozzles 16*b* and 16*c* respectively to impinge upon the common location on the inner wall surface 5 of the funnel-like body 4 are moved along the inner wall surface 5 to form their respective streams flowing toward the open end portion 4*a* of the funnel-like body 4 through the holes 8 provided at the connecting portion between the funnel-like body 4 and the hub member 6. The streams of the coating base and hardening agent flowing along the inner wall surface 5 toward the open end portion 4*a* are affected with centrifugal force resulting from the rotation of the rotary spray head device 2 at the high speed so as to form thier respective layers Fa and Fi superimposed on the inner wall surface 5, as shown in FIG. 1. In such case, the stream of the coating base which is larger in specific gravity than the hardening agent forms the layer Fa coming into contact directly with the inner wall surface 5, and the stream of the hardening agent forms the layer Fi put on the layer Fa. That is, the coating base and hardening agent supplied to the rotary spray head device 2 are caused to form the layers Fa and Fi superimposed on the inner wall surface 5 of the funnel-like body 4 and to move toward the open end portion 4*a* of the funnel-like body 4.

The coating base and hardening agent forming the layers Fa and Fi and having reached to the open end portion 4*a* are sprayed from the open end portion 4*a* toward the object to be coated by means of the centrifugal force resulting from the rotation of the rotary spray head device 2 at the high speed so as to form almost innumerable sprayed particles R, as shown in FIG. 1. Since the coating base and hardening agent which form the layers Fa and Fi piled on the inner wall surface 5 is directly sprayed toward the object to be coated, each of the sprayed particles R has a couple of layers formed with the coating base and hardening agent, respectively, and therefore the coating base and hardening agent sprayed from the open end portion 4*a* of the funnel-like body 4 are mixed sufficiently with each other. As a result, the object to be coated is provided on its outer surface with a coating layer which is made uniform with the coating base composed of acrylic resin coating material including white pigment and the hardening agent of isocyanate which are mixed each other with a ratio in weight of the hardening agent to the coating base set to be one third.

In the case where a change of color of the coating base is intended after the electrostatic spray coating for the object with use of the coating base composed of acrylic resin coating material including white pigment is finished as described above, in order to conduct next electrostatic spray coating for another object to be coated with use of the coating base composed of acrylic resin coating material including red pigment, the pumps 27 and 28 are shut off so that the coating base and instead agent are prevented from being drawn from the coating tank 33 and hardening agent tank 34, respectively, and instead of this the pump 37 provided for the pipe 35 for supplying the washing agent is started up. With the operation of the pump 37, the washing agent stored in the washing agent tank 38 is supplied through the pipe 35 to the nozzle 18. The flow controller 36 is operative to adjust the flow of the washing agent in the pipe 35 to be appropriate. The washing agent supplied to the nozzle 18 is discharged from the discharging opening 18*a* of the nozzle 18 to the inner wall surface 5 of the funnel-like body 4 of the rotary spray head device 2 so as to wash the inside of the funnel-like body 4.

After that, the pump 37 is stopped working, and instead the pumps 26 and 28 are started up so that the coating base stored in the coating tank 32 and the hardening agent stored in the hardening agent tank 34 are supplied respectively through the pipes 20*a* and 20*c* to the nozzles 16*a* and 16*c* in the coating supply nozzle portion 16 with a ratio in weight of the hardening agent to the coating base set to be appropriate by the flow controllers 22 and 24. The coating base supplied to the nozzle 16*a* and the hardening agent supplied to the nozzle 16*c* are discharged simultaneously from the discharging openings 17*a* and 17*c*, respectively, to the inner wall surface 5 of the funnel-like body 4 of the rotary spray head device 2 turning at the high speed. In this case also, the discharging openings 17*a* and 17*c* of the nozzles 16*a* and 16*c* are stacked in the direction along the radius of the funnel-like body 4 of in the vicinity of the inner wall surface 5 of the funnel-like body 4, as shown in FIG. 2, and therefore the coating base discharged from the discharging opening 17*a* of the nozzle 16*a* and the hardening agent discharged from the discharging opening 17*c* of the nozzle 16*c* impinge upon a common location on the inner wall surface 5 of the funnel-like body 4 of the rotary spray head device 2 turning at the high speed.

Accordingly, the coating base and hardening agent supplied to the rotary spray head device 2 are caused to form their respective layers superimposed on the inner wall surface 5 of the funnel-like body 4 and to move toward the open end portion 4*a* of the funnel-like body 4 so as to be sprayed therefrom toward the object to be coated. As a result, the coating base and hardening agent sprayed from the open end portion 4*a* of the funnel-like body 4 are mixed sufficiently with each other, and the object to be coated is provided on its outer surface with a coating layer which is made uniform with the coating base composed of acrylic resin coating material including red pigment and the hardening agent of isocyanate mixed with each other at an appropriate ratio in weight of the hardening agent to the coating base.

With use of the apparatus shown in FIG. 1, it is also possible to cause the pumps 26, 27 and 28 to operate simultaneously so that the coating base composed of acrylic resin coating material including red pigment and stored in the coating tank 32, the coating base composed of acrylic resin coating material including white pigment and stored in the coating tank 33, and the hardening agent stored in the hardening agent tank 34 are supplied respectively through the pipes 20*a*, 20*b* and 20*c* to the nozzles 16*a*, 16*b* and 16*c* in the coating supply nozzle portion 16, and then to cause the coating bases supplied to the nozzles 16*a* and 16*b* and the hardening agent supplied to the nozzle 16*c* to be discharged simultaneously from the discharging openings 17*a*, 17*b* and 17*c*, respectively, to the inner wall surface 5 of the funnel-like body 4 of the rotary spray head device 2 turning at the high speed. The coating bases discharged from the discharging openings 17*a* and 17*b* of the nozzles 16*a* and 16*b* and the hardening agent discharged from the discharging opening 17*c* of the nozzle 16*c* impinge upon a common location on the inner wall surface 5 of the funnel-like body 4 of the rotary spray head device 2 turning at the high speed.

In such a case as described above, the coating bases discharged from the nozzles 16*a* and 16*b* and the hardening agent discharged from the nozzle 16*c* are caused to form their respective layers superimposed on the inner wall surface 5 of the funnel-like body 4 and to move toward the open end portion 4*a* of the funnel-like body 4 so as to be sprayed therefrom toward an object to be coated. As a result, the object to be coated is provided on its outer surface with a coating layer which is made uniform with the coating base composed of acrylic resin coating material including red pigment, the coating base composed of acrylic resin coating material including white pigment, and the hardening agent of isocyanate mixed with one another at an appropriate ratio in weight of the hardening agent to the coating bases.

It is further possible to have the coating tanks 32 and 33 in the apparatus shown in FIG. 1 stored, for example, red coating and white coating both being of melamine alkyd resin, and to conduct electrostatic spray coating for an object to be coated with use of both the red and white coating in accordance with the method of the present invention.

In this case, first, the pumps 26 and 27 are started up so that the red coating stored in the coating tank 32 and the white coating stored in the coating tank 33 are supplied respectively through the pipes 20*a* and 20*b* to the nozzles 16*a* and 16*b* in the coating supply nozzle portion 16 with a ratio in weight of the white coating to the red coating set to be appropriate by the flow controllers 22 and 23. Then, the red coating supplied to the nozzle 16*a* and the white coating supplied to the nozzle 16*b* are discharged simultaneously from the discharging openings 17*a* and 17*b*, respectively, to the inner wall surface 5 of the funnel-like body 4 of the rotary spray head device 2 turning at the high speed. The red coating discharged from the discharging opening 17*a* of the nozzle 16*a* and the white coating discharged from the discharging opening 17*b* of the nozzle 16*b* impinge upon a common location on the inner wall surface 5 of the funnel-like body 4 of the rotary spray head device 2 turning at the high speed.

Accordingly, the red coating and white coating supplied to the rotary spray head device 2 are caused to form their respective layers superimposed on the inner wall surface 5 of the funnel-like body 4 and to move toward the open end portion 4*a* of the funnel-like body 4 so as to be sprayed therefrom toward the object to be coated. As a result, the object to be coated is provided on its outer surface with a coating layer which is made uniform with the red coating and the white coating mixed with each other at an appropriate ratio in weight of the white coating to the red coating.

Figure 3:
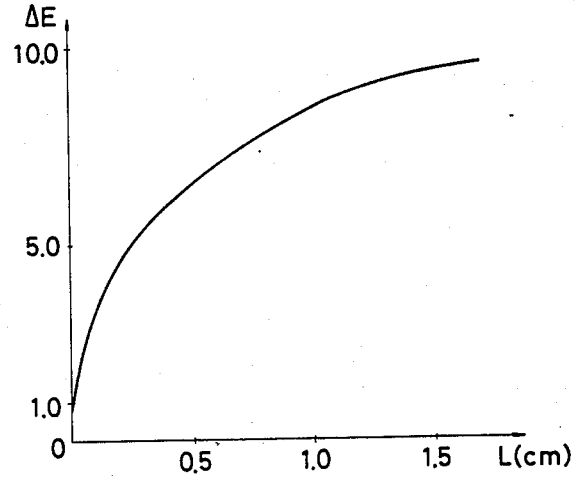
FIG. 3 is a graph used for explaining a condition of coating provided on an object to be coated through the embodiment of method of conducting electrostatic spray coating according to the present invention, in which the rotary spray head device shown in FIG. 2 is used.

Now, in relation to the case where two different kinds of coating are caused to impinge upon the inner wall surface 5 of the funnel-like body 4 of the rotary spray head device 2 turning at a high speed and sprayed from the open end portion 4*a* of the funnel-like body 4 toward an object to be coated, such as mentioned above, the relation between a coating condition on the object to be coated and a distance L between locations on the inner wall surface 5 of the funnel-like body 4 upon which the two different kinds of coating impinge respectively, will be set forth below with reference to FIG. 3. FIG. 3 shows experimental results for the nonuniformity in color of coating disposed on the object on a graph which has the ordinate representing color difference $\Delta E$ between each of coating layers disposed on the object and a reference color coating, and the abscissa representing the distance L.

As apparent from FIG. 3, the color difference $\Delta E$ is very small when the distance L is zero or close to zero, and the color difference $\Delta E$ increases according as the increase of the distance L. This means that the object is provided on its outer surface with a coating layer having superior uniformity when the two different kinds of coating material are caused to impinge respectively upon locations close to each other on the inner wall surface 5 of the funnel-like body 4. Accordigly, it is to be clearly understood that the above mentioned object which is subjected to the electrostatic spray coating conducted with use of the red coating and white coating which are caused to impinge upon the common location on the inner wall surface 5 of the funnel-like body 4 in accordance with one embodiment of the method of -the present invention, is provided thereon will a coating layer superior in color uniformity.

Figure 4:
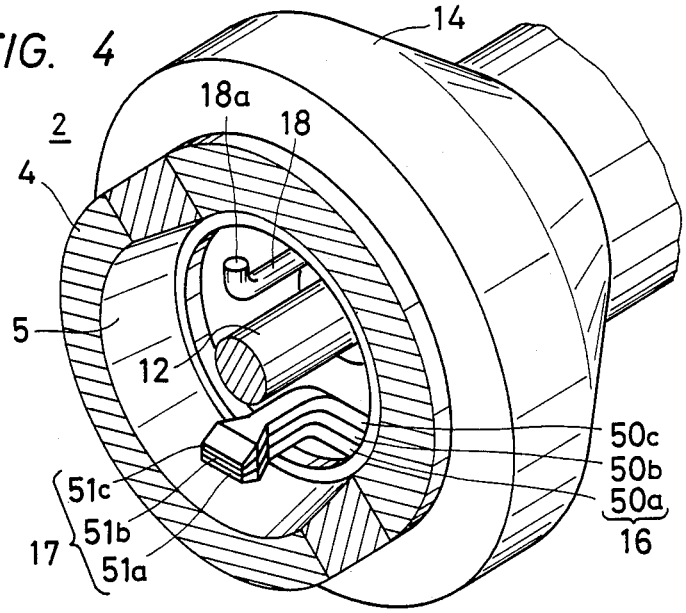
FIGS. 4, 5, 6A, 6B, 8A, 8B, 9 and 10 are fragmentary perspective views and sectional views showing other embodiments of rotary spray head device which are to be employed selectively in the apparatus for use in the embodiment of method of conducting electrostatic spray coating according to the present invention.
Figure 5:
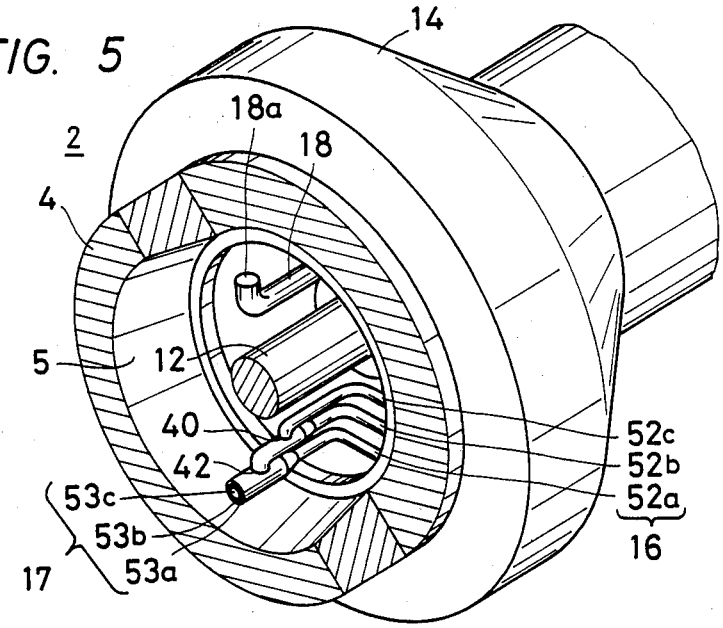

FIGS. 4 and 5 show parts of other embodiments of rotary spray head device 2 each including the coating supply nozzle portion 16 and the circumference thereof.

In the embodiment of rotary spray head device 2 shown in FIG. 4, a coating supply nozzle portion 16 comprises nozzles 50*a* and 50*b* for discharging coating bases, respectively, and a nozzle 50*c* for discharging a hardening agent. The nozzles 50*a*, 50*b* and 50*c* are connected respectively to the pipes 20*a*, 20*b* and 20*c* shown in FIG. 1 and each of the nozzles 50*a*, 50*b* and 50*c* has a compressed end portion in which each of discharging openings 51*a*, 51*b* and 51*c* is provided. The discharging openings 51*a*, 51*b* and 51*c* which form a discharging opening end 17 are stacked in the direction along the radius of a funnel-like body 4 in the vicinity of an inner wall surface 5 of the funnel-like body 4. In the case of such embodiment, a coating base and a hardening agent or two different kinds of coating supplied thereto to be discharged to the inner wall surface 5 are facilitated to form their respective layers superimposed on the inner wall surface 5.

In the embodiment of rotary spray head device 2 shown in FIG. 5, a coating supply nozzle portion 16 comprises nozzles 52*a* and 52*b* for discharging coating bases, respectively, and a nozzle 52*c* for discharging a hardening agent. The nozzles 52*a*, 52*b* and 52*c* are connected respectively to the pipes 20*a*, 20*b* and 20*c* shown in FIG. 1. The nozzle 52*c* has its end portion which is provided with a discharging openings 53*c* and inserted through an opening 40 provided on the nozzle 52*b* into an end portion of the nozzle 52*b* in which a discharging opening 53*b* is provided. Further, the end portion of the nozzle 52*b* is inserted through an opening 42 provided on the nozzle 52*a* into an end portion of the nozzle 52*a* in which a discharging opening 53*a* is provided. The discharging openings 53*a*, 53*b* and 53*c* are arranged concentrically to form a discharging opening end 17 and have respective portions stacked in the direction along the radius of a funnel-like body 4 in the vicinity of an inner wall surface 5 of the funnel-like body 4.

In the case where one of the embodiments of rotary spray head device 2 shown in FIGS. 2, 4 and 5 is used for the apparatus shown in FIG. 1, the coating supply nozzle portion 16 is provided to elongate in substantially parallel with the axis of rotation of the rotary spray head devices 2, and therefore it is feared that a fluid of the coating base and hardening agent or two different kinds of coating is discharged from the coating supply nozzle portion 16 to impinge upon the hub member 6 and a pulsation stream of the fluid arises on the inner wall surface 5, when the fluid is discharged in large quantities from the coating supply nozzle portion 16. Such pulsation stream of the fluid may give rise to a disadvantage that the coating base and hardening agent or the two different kinds of coating sprayed from the open end portion 4*a* of the funnel-like body 4 are not mixed uniformly with each other.

Figure 6A:
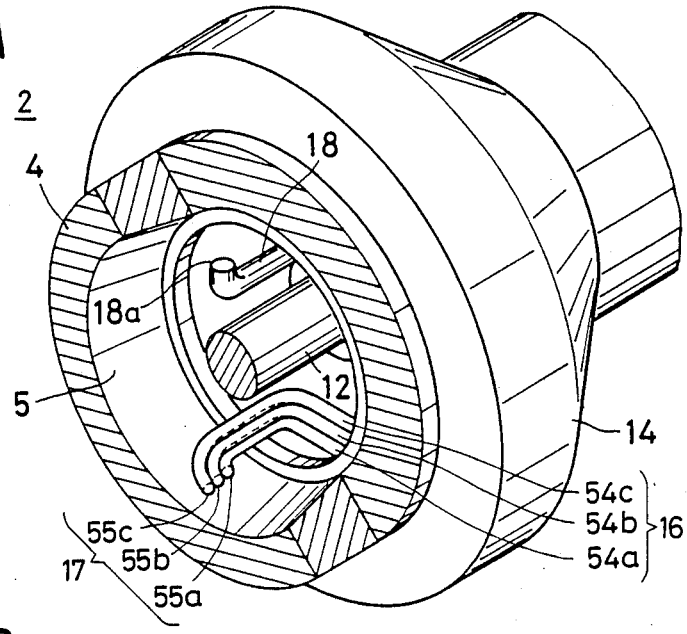
Figure 6B:
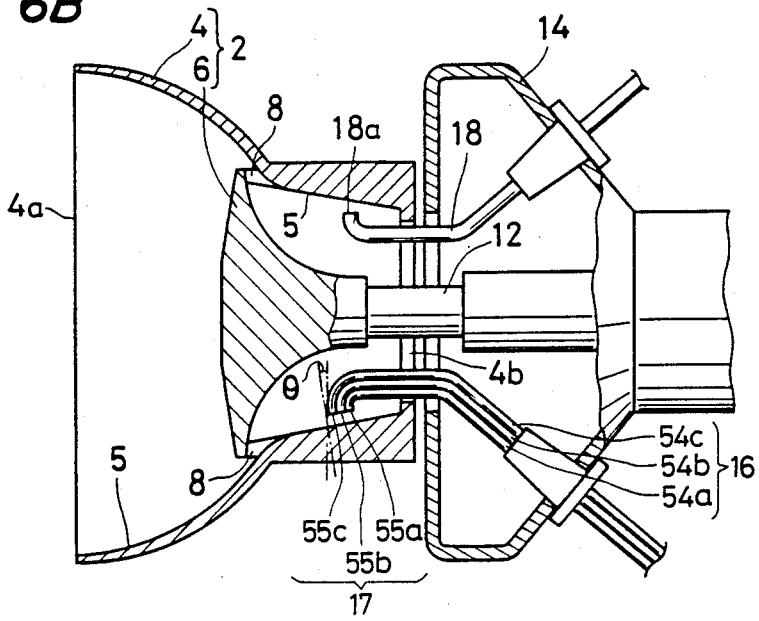

When it is intended to avoid such disadvantage as mentioned above, a further embodiment of rotary spray head device 2 as shown in FIGS. 6A and 6B is employed in the apparatus shown in FIG. 1.

In the embodiment of rotary spray head device 2 shown in FIGS. 6A and 6B, a coating supply nozzle portion 16 comprises nozzles 54*a* and 54*b* for discharging coating bases, respectively, and a nozzle 54*c* for discharging a hardening agent. The nozzles 54*a*, 54*b* and 54*c* are connected respectively to the pipes 20*a*, 20*b* and 20*c* shown in FIG. 1 and each of the nozzles 54*a*, 54*b* and 54*c* has an end portion which is provided therein with each of discharging openings 55*a*, 55*b* and 55*c* and bent toward the inner wall surface 5 of the funnel-like body 4 so as to cause each of discharging openings 55*a*, 55*b* and 55*c* to face the inner wall surface 5 of the funnel-like body 4. The discharging openings 55*a*, 55*b* and 55*c* which form a discharging opening end 17 are arranged in the direction, along the axis of rotation of the rotary spray head device 2, as shown clearly in FIG. 6B. Incidentally, each of the end portions of the nozzles 54*a*, 54*b* and 54*c* is bent at such an angle that the coating base, hardening agent or coating material discharged therefrom is caused to impinge upon the inner wall surface 5 of the funnel-like body 4 with an incident angle of less than 45 degrees measured with reference to a normal for the inner wall surface 5 of the funnel-like body 4.

In the case of such embodiment, the coating base and hardening agent or two different kinds of coating discharged from the nozzles 54*a*, 54*b* and 54*c* impinge directly upon the inner wall surface 5 of the funnel-like body 4 even when the coating base and hardening agent or two different kinds of coating are discharged in large quantities from the nozzles 54*a*, 54*b* and 54*c*. Accordingly, any pulsation stream of the coating base and hardening agent or two different kinds of coating are prevented from arising on the inner wall surface 5 of the funnel-like body 4.

Figure 7:
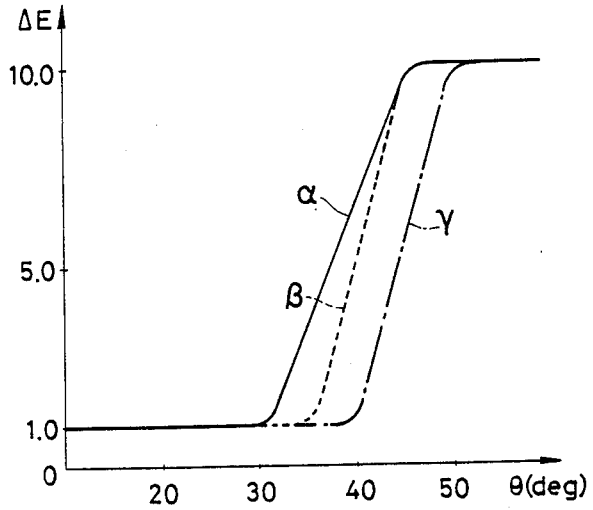
FIG. 7 is a graph used for explaining a condition of coating provided on an object to be coated through the embodiment of method of conducting electrostatic spray coating according to the present invention, in which the rotary spray head device shown in FIGS. 6A and 6B.

In relation to the case where two different kinds of coating are caused to impinge upon the inner wall surface 5 of the funnel-like body 4 of such a rotary spray head device 2 as shown in FIGS. 6A and 6B to be sprayed from the open end portion 4*a* of the funnel-like body 4 toward an object to be coated, the relation between a coating condition on the object to be coated and an incident angle $\theta$ to a normal for the inner wall surface 5 of each of the two different kinds of coating, will be set forth below with reference to FIG. 7. FIG. 7 shows experimental results for the ununiformity in color of coating deposited on the object on a graph which has the ordinate representing color difference $\Delta E$ between each of coating layers deposited on the object and a reference color coating, and the abscissa representing the incident angle $\theta$ and in which a solid line $\alpha$, broken line $\beta$ and dot-dash line $\gamma$ stand for results obtained under discharging quantities of 300 ml/min, 200 ml/min and 50 ml/min, respectively. As apparent from FIG. 7, the color difference $\Delta E$ is relatively large regardless of the discharging quantity under the situation in which the incident angle $\theta$ is more than about 60 degrees, is relatively small only when the discharging quantity is small under the situation in which the incident angle $\theta$ is more than about 45 degrees but less than about 60 degrees, and is relatively small regardless of the discharging quantity under the situation in which the incident angle $\theta$ is less than about 45 degrees.

Accordingly, it is to be clearly understood that an object to be coated which is subjected to the electrostatic spray coating conducted with use of the embodiment of the rotary spray head device shown in FIGS. 6A and 6B in which each of the coating base and hardening agent or two different kinds of coating is caused to impinge upon the inner wall surface 5 of the funnel-like body 4 with the incident angle of less than 45 degrees in accordance with one embodiment of method of the precent invention, is provided thereon the coating layer superior in color uniformity.

In the case where one of the embodiments of rotary spray head device 2 shown in FIGS. 2, 4, 5, 6A and 6B is used for the apparatus shown in FIG. 1, the discharging openings forming the discharging opening end 17 are close to one another and therefore it is feared that the hardening agent will act upon the coating base so as to harden the same at the location of the discharging opening end 17 and as a result the coating base and hardening agent will be prevented from being discharged properly from the discharging opening end 17 the inner wall surface 5 of the funnel-like body 4.

Figure 8A:
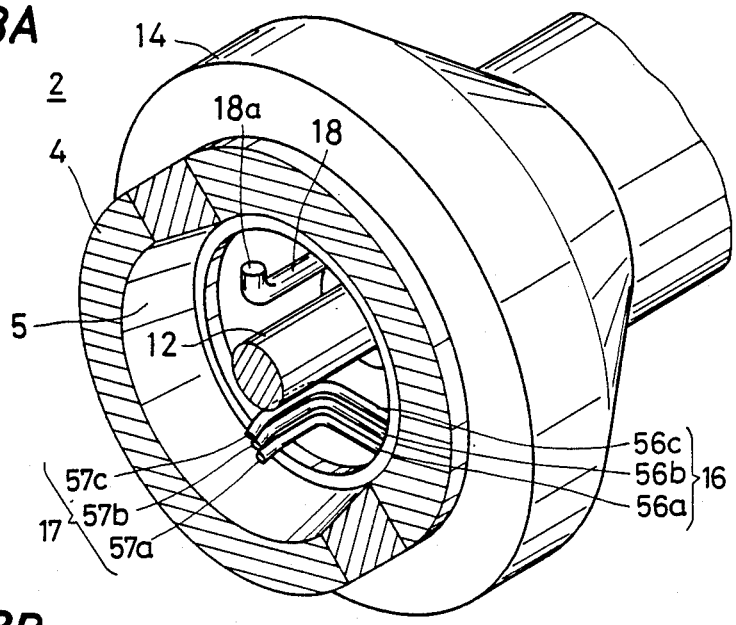
Figure 8B:
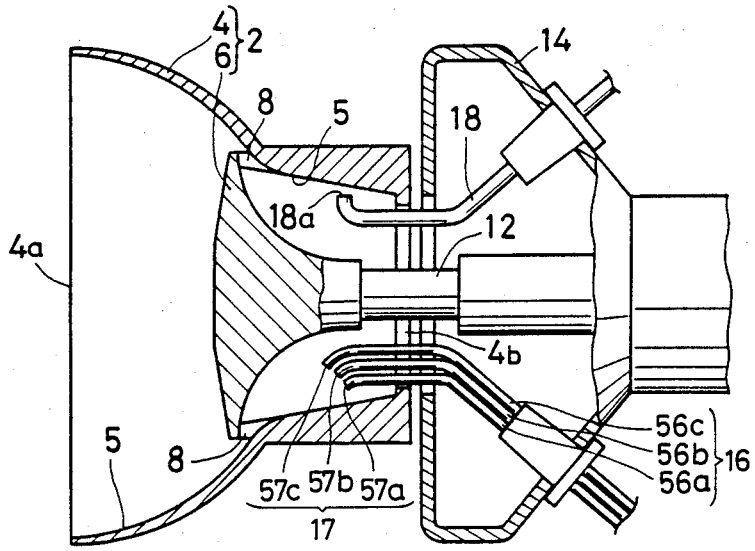

When it is intended to avoid such a problem, a still further embodiment of rotary spray head device 2 as shown in FIGS. 8A and 8B is employed in the apparatus shown in FIG. 1.

In the embodiment of rotary spray head device 2 shown in FIGS. 8A and 8B, a coating supply nozzle portion 6 comprises nozzles 56*a* and 56*b* for discharging coating bases, respectively, and a nozzle 56*c* for discharging a hardening agent. These nozzles 56*a*, 56*b* and 56c are connected respectively to the pipes 20a, 20b and 20c shown in FIG. 1. Discharging openings 57a, 57b and 57c of the nozzles 56a, 56b and 56c, which form the discharging opening end 17, are stacked with a space between each adjacent two thereof in the direction along the radius of the funnel-like body 4 of the rotary spray head device 2 in the vicinity of the inner wall surface 5 of the funnel-like body 4. Further., an end portion of each of the nozzles 56a, 56b and 56c, in which each of the discharging openings 57a, 57b and 57c is provided, is bent toward the inner wall surface 5 of the funnel-like body 4 so as to cause each of the discharging openings 57a, 57b and 57c to face the inner wall surface 5 of the funnel-like body 4.

In the case of such embodiment, since the discharging openings 57a, 57b and 57c of the nozzles 56a, 56b and 56c are arranged with the space between each adjacent two, the hardening agent discharged from the discharging openings 57c is prevented from acting upon the coating base discharged from at least one of the discharging openings 57a and 57b so as to harden the same at the locations of the discharging openings 57a, 57b and 57c, and the coating base discharged from at least one of the discharging openings 57a and 57b and the hardening agent discharged from the discharging opening 57c meet each other in the air to impinge together upon the inner wall surface 5 of the funnel-like body 4.

Figure 9:
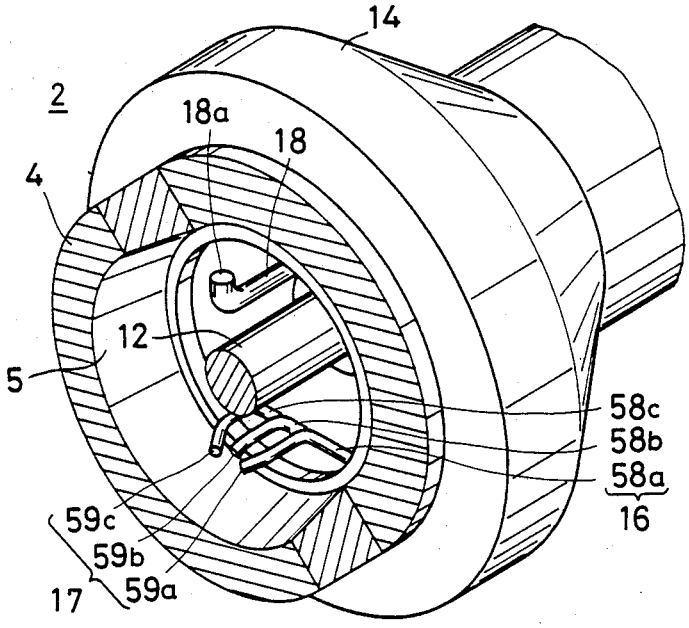

Although the discharging openings 57a, 57b and 57c of the nozzles 56a, 56b are stacked in the direction along the radius of the funnel-like body 4 of the rotary spray head device 2 in the embodiment of rotary spray head device 2 shown in FIGS. 8A and 8B, it is possible to arrange the discharging openings 57a, 57b and 57c of the nozzles 56a, 56b and 56c with a predetermined space between each adjacent two thereof in the direction along the circumference of a circle around the axis of rotation of the rotary spray head device 2, in such a manner as shown as discharging openings 59a, 59b and 59c of nozzles 58a, 58b and 58c in FIG. 9.

Figure 10:
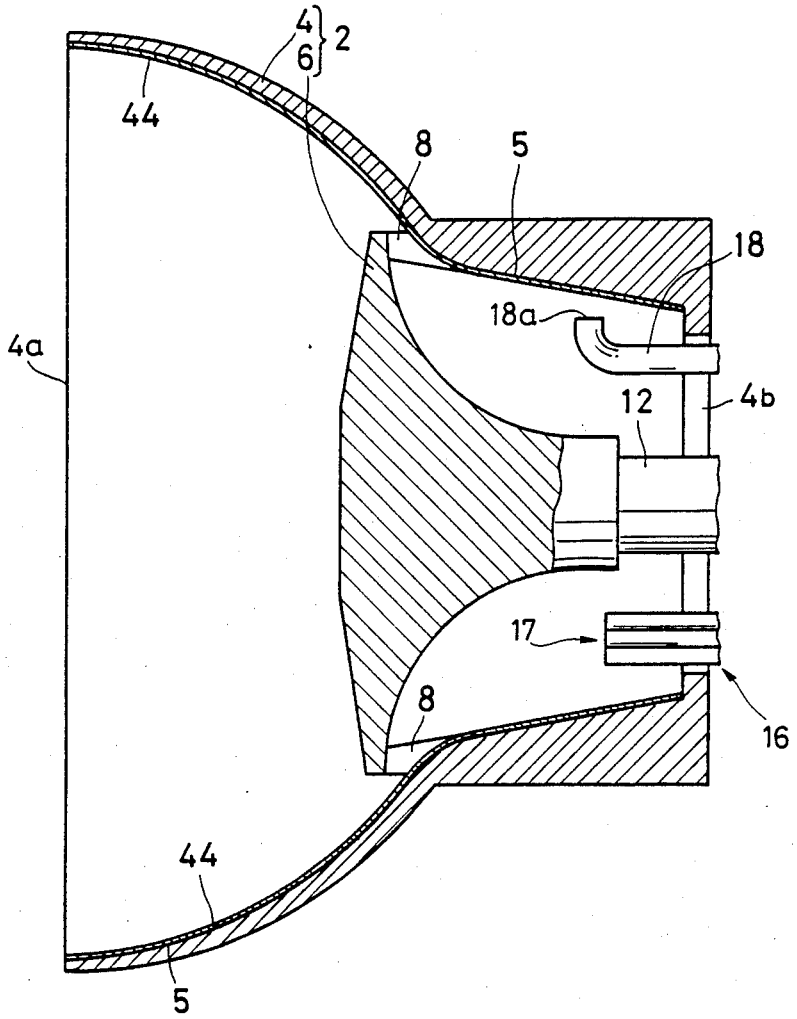

FIG. 10 shows a further different embodiment of rotary spray head device 2 for use in the apparatus shown in FIG. 1. This embodiment of rotary spray head device 2 is intended to have reduced flow resistance at the inside thereof.

In the embodiment of rotary spray head device 2 shown in FIG. 2, an inner wall surface 5 of a funnel-like body 4 is covered by a surface treating layer 44 which contributes to reduce flow resistance against a coating base and hardening agent or coating on the inner wall surface 5. The surface treating layer 44 is formed with a layer of fluoridated resin, a plating layer including nickel and fluoridated resin, flame coating layer of molybdenum, or the like. The inner wall surface 5 which is covered by the surface treating layer 44 is previously processed to have surface roughness reduced sufficiently, for example, such surface roughness as containing the maximun height less than 0.5 $\mu$.

Although the coating supply nozzle portion 16 is constituted to include the nozzle for discharging a hardening agent in addition to the nozzles for discharging coating bases or different kinds of coating material in the embodiments described above, it is to be understood that another coating supply nozzle portion which does not include a nozzle for discharging the hardening agent may be employed in place of the coating supply nozzle portion 16.

What is claimed is:

1. A method of conducting electrostatic spray coating comprising:

driving a rotary spray head device for electrostatic spray coating which is provided with a funnel-like body having an inner wall surface for guiding coating material and an open end portion at the side of larger diameter thereof, to turn on an axis of rotation surrounded by said inner wall surface of the funnel-like body, and supplying plural kinds of coating material to said inner wall surface of the funnel-like body of the rotary spray head device at a substantially common location thereon simultaneously through respective separate paths so that said plural kinds of coating material form their respective layers superimposed on each other and on said inner wall surface of the funnel-like body and so that said plural kinds of coating material move toward said open end portion of the funnel-like body.

2. A method of conducting electrostatic spray coating comprising:

driving a rotary spray head device for electrostatic spray coating which is provided with a funnel-like body having an inner wall surface for guiding coating material and an open end portion at the side of larger diameter thereof, to turn on an axis of rotation surrounded by said inner wall surface of the funnel-like body, and supplying a coating base and a hardening agent to said inner wall surface of the funnel-like body of the rotary spray head device at a substantially common location thereon simultaneously through respective separate paths so that said coating base and hardening agent form their respective layers superimposed on each other and on said inner wall surface of the funnel-like body and so that said coating base and said hardening agent move toward said open end portion of the funnel-like body.

3. A method of conducting electrostatic spray coating comprising:

driving a rotary spray head device for electrostatic spray coating which is provided with a funnel-like body having an inner wall surface for guiding coating material and an open end portion at the side of larger diameter thereof, to turn on an axis of rotation surrounded by said inner wall surface of the funnel-like body, and supplying a plurality of different kinds of material to said inner wall surface of the funnel-like body of the rotary spray head device at a substantially common location thereon simultaneously through respective separate paths so that said different kinds of material form their respective layers superimposed on each other and on said inner wall surface of the funnel-like body and so that said different kinds of material move toward said open end portion of the funnel-like body.

4. An apparatus for conducting electrostatic spray coating comprising:

a rotary spray head provided with a funnel-like body which has an inner wall surface for guiding coating material and an open end portion at the side of larger diameter thereof, a driving device for driving said rotary spray head device to turn on an axis of rotation surrounded by said inner wall surface of the funnel-like body, and a plurality of nozzles each having its discharging opening positioned to be close to said inner wall surface of the funnel-like body of the rotary spray head device for supplying plural kinds of coating material respectively to said inner wall surface of the funnel-like body at a substantially common location thereon simultaneously through respective separate paths so that said plural kinds of coating material form their respective layers superimposed on each other and on said inner wall surface of the funnel-like body and so that said plural kinds of coating material move toward said open end portion of the funnel-like body.

5. An apparatus according to claim 4, wherein said rotary spray head device is further provided with a hub member disposed at the inside of said funnel-like body to be connected with both said funnel-like body and said driving device.

6. An apparatus according to claim 5, wherein said rotary spray head device is further provided with a plurality of holes formed at a connecting portion between said funnel-like body and said hub member.

7. An apparatus according to claim 4, wherein said rotary spray head device is further provided with a surface treating layer covering said inner wall surface of the funnel-like body for reducing flow resistance against said plural kinds of coating material on said inner wall surface of the funnel-like body.

8. An apparatus according to claim 4 further comprising an additional nozzle having its discharging opening positioned to be close to said inner wall surface of the funnel-like body of the rotary spray head device for discharging a washing agent to said inner wall surface of the funnel-like body.

9. An apparatus for conducting electrostatic spray coating comprising:

a rotary spray head provided with a funnel-like body which has an inner wall surface for guiding coating material and an open end portion at the said of larger diameter thereof, a driving device for driving said rotary spray head device to turn on an axis of rotation surrounded by said inner wall surface of the funnel-like body, and a plurality of nozzles each having its discharging opening for supplying plural kinds of coating material respectively to said inner wall surface of the funnel-like body at a common location thereon simultaneously through respective separate paths, said discharging openings of the nozzles being stacked in a direction perpendicular to said axis of rotation in the vicinity of said inner wall surface of the funnel-like body for discharging therefrom said plural kinds of coating material respectively so that said plural kinds of coating material form their respective layers superimposed on each other and on said inner wall surface of the funnel-like body and so that said plural kinds of coating material move toward said open end portion of the funnel-like body.

10. An apparatus according to claim 9, wherein said discharging openings of the nozzles are arranged with a predetermined space between each adjoining two thereof so that the plural kinds of coating material discharged from said discharging openings meet each other in the air and then impinge together upon said inner wall surface of the funnel-like body.

11. An apparatus according to claim 9, wherein said rotary spray head device is further provided with a surface treating layer covering said inner wall surface of the funnel-like body for reducing flow resistance against said plural kinds of coating material on said inner wall surface of the funnel-like body.

12. An apparatus for conducting electrostatic spray coating comprising:

a rotary spray head provided with a funnel-like body which has an inner wall surface for guiding coating material and an open end portion at the side of larger diameter thereof, a driving device for driving said rotary spray head device to turn on an axis of rotation surrounded by said inner wall surface of the funnel-like body, and a plurality of nozzles each having a discharging opening at one end portion thereof for supplying plural kinds of coating material respectively to said inner wall surface of the funnel-like body at a substantially common location thereon simultaneously through respective separate paths, each said one end portion of the nozzles being bent such that each of said discharging opening faces said inner wall surface of the funnel-like body so that the plural kinds of coating material discharged from said discharging openings of the nozzles impinge directly upon said wall surface of the funnel-like body so as to form their respective layers superimposed on each other and on said inner wall surface of the funnel-like body and so that said plural kinds of coating material move toward said open end portion of the funnel-like body.

13. An apparatus according to claim 12, wherein said discharging openings of the nozzles are arranged in a direction along said axis of rotation.

14. An apparatus according to claim 12, wherein said discharging openings of the nozzles are disposed with a predetermined space between each adjoining two thereof so that the plural kinds of coating material discharged from said discharging openings meet each other in the air and then impinge together upon said inner wall surface of the funnel-like body.

15. An apparatus according to claim 12, wherein said rotary spray head device is further provided with a surface treating layer covering said inner wall surface of the funnel-like body for reducing flow resistance against said plural kinds of coating material on said inner wall surface of the funnel-like body.

* * * * *